US005292077A

United States Patent [19]

Inui et al.

[11] Patent Number: 5,292,077

[45] Date of Patent: Mar. 8, 1994

[54] FLOW RATE REGULATOR FOR USE IN A BALL MILL

[75] Inventors: Yasuo Inui; Nobuhito Yagi, both of Osaka, Japan

[73] Assignee: Kurimoto, Ltd., Osaka, Japan

[21] Appl. No.: 726,959

[22] Filed: Jul. 8, 1991

[30] Foreign Application Priority Data

Mar. 29, 1991 [JP] Japan ..... 3-028520[U]

[51] Int. Cl.[5] ..... B02C 17/02

[52] U.S. Cl. ..... 241/72; 241/171; 403/58

[58] Field of Search ..... 241/71, 72, 171; 403/58

[56] References Cited

U.S. PATENT DOCUMENTS

| | | | |
|---|---|---|---|
| 1,058,953 | 4/1913 | Easton | 241/171 |
| 1,498,712 | 6/1924 | York | 403/58 |
| 3,799,458 | 3/1974 | Lutke-Cossmann | 241/70 |
| 3,990,644 | 11/1976 | Hanke et al. | 241/171 |
| 4,089,477 | 5/1978 | Tiggesbaumker et al. | 241/78 |

FOREIGN PATENT DOCUMENTS 1174047 12/1989 Japan .

*Primary Examiner*—Mark Rosenbaum
*Assistant Examiner*—John M. Husar
*Attorney, Agent, or Firm*—Jones, Tullar & Cooper

[57] ABSTRACT

Flow rate of material passing through a partition diaphragm of a ball mill is regulated. One end of a disc controller is mounted on an outer shell of the ball mill, and a control disc is mounted on the other end through a diaphragm chamber formed inside the partition diaphragm. The disc controller performs an opening and closing operation of a discharge opening by moving to and from a center core A disk adjust bar 41, a universal joint 45 and a disc holder bar 50 are connected in such a manner as to be separately bendable with respect to each other. The opening and closing operation performed by the control disc is not affected by deformation of the outer shell of the ball mill or any positional change during operation.

2 Claims, 4 Drawing Sheets

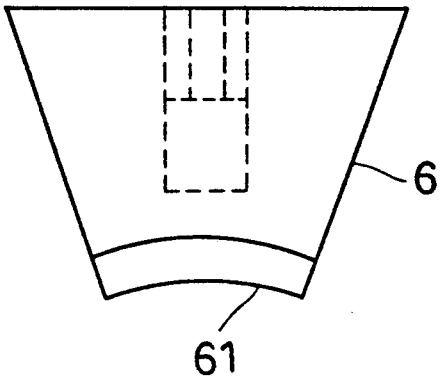
FIG. 3(A)
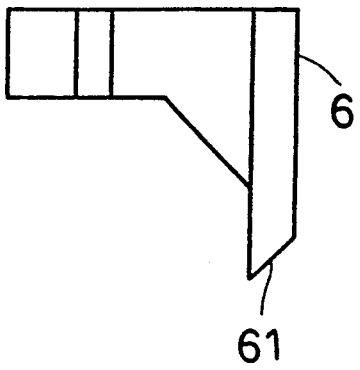
FIG. 3(B)
Fig. 4
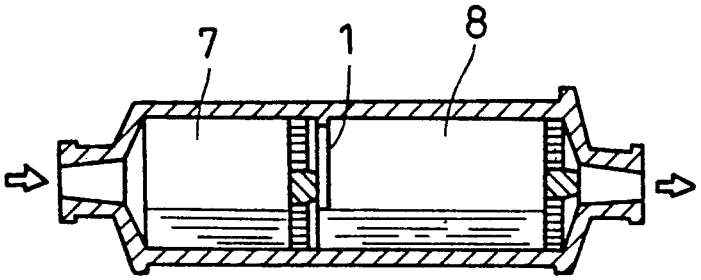
Fig. 5
Prior Art
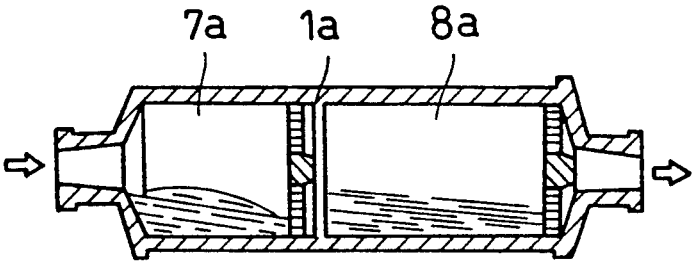

FLOW RATE REGULATOR FOR USE IN A BALL MILL

BACKGROUND OF THE INVENTION

1. Field of the invention

The present invention relates to a ball mill for grinding materials such as cement clinker and, more particularly, to a flow rate regulator to be used in combination with a partition diaphragm in the ball mill, the partition diaphragm being formed inside a body of the mill and having multi-grinding chambers.

2. Prior art

Generally, plural grinding chambers, i.e., multi-grinding chambers are provided in a ball mill for the purpose of improving productivity while reducing energy cost per material thereby improving the grinding efficiency as a whole, and in which a series of grinding processes are performed comprising the steps of primarily grinding a bulky material using a ball of large diameter (serving as grinding medium) in a primary grinding chamber; filtering the material ground to a certain grain size; feeding the filtered material to a secondary grinding chamber; and grinding the fed material finely.

For that purpose, it is an essential requirement to balance the level of material supplied in the primary grinding chamber with the level of material supplied in the secondary grinding chamber. It is often the case, however, that the amount of material fed from the primary grinding chamber to the secondary grinding chamber passing through the filtering slits exceeds the grinding capacity of the secondary grinding chamber, and that a number of relatively large size grains are mixed in the material and left in the material fed to the secondary grinding chamber and discharged therefrom as they are not ground further. This results in the application of a further load on the secondary grinding chamber. Such a disadvantage can be obviously recognized by checking the lowest level of the material presented in the vertical section of the first and second grinding chambers as shown in FIG. 5. That is, referring to FIG. 5, the level of the moving material immediately before the partition diaphragm of the primary grinding chamber is largely lowered, and as a result the grinding efficiency at this portion is also largely lowered. This negative influence is carried over to the next secondary grinding chamber, and such an unbalanced movement of the material will eventually bring about a decline in the grinding performance of the entire ball mill.

To regulate the balance between the two grinding chambers, first it is necessary to establish a suitable clearance of the slits of the partition diaphragm. Then it is preferable to appropriately regulate the rate of flow from the partition diaphragm to the secondary grinding chamber. It is to be noted that even though a rate of flow is once adequately balanced and the grinding operation takes place efficiently for a certain period based upon such predetermined balance, it is often the case that grindability and grain size distribution of cement clinker ground by the ball mill is not always constant but variable. It is, therefore, required to regulate the rate of flow from time to time following the variation.

To meet the mentioned requirement, Japanese Laid-Open Utility Model publication (unexamined) No.1-174047 proposed a construction as shown in FIGS. 6(A) and 6(B), in which a screen plate 11*b* of the primary grinding chamber side is disposed on the front face of a partition diaphragm 1*b* and a screen plate 12*b* of the secondary grinding chamber is disposed on the rear face thereof to form a diaphragm chamber 14*b* in a space between the two screen plates. The circumference of the partition diaphragm is divided radially from a center core 2*b* into several divisions, and in each of the divisions a disc controller 4*b* is provided through the diaphragm chamber 14*b* from the outer shell 3*b* toward the center. A control disc 6*b* is mounted on one end of the disc controller 4*b* to open and close a discharge opening 17*b* provided surrounding the center core 2*b* by engaging and disengaging with a control disc seat 9 adjacent the discharge opening 17*b*. The disc controller 4*b* is supported by a support 10 in the diaphragm chamber and secured by driving a screw through the outer shell 3*b* of the mill on the outer periphery thereof. Accordingly, when driving the screw, the control disc 6*b* moves separating itself from the control disc seat 9, thereby all material in the diaphram chamber moves into the secondary grinding chamber. In this manner, the rate of flow passing through the diaphram chamber can be regulated by adjusting the relative position between the disc controller 4*b* and the control disc seat 9.

As is well known, a ball mill for grinding cement clinker is a rotating apparatus having a huge cylinder, the diameter of which amounts to 5.2 m with a length of up to 16.0 m (in case of the largest one) and in which a heavy weight ball is inserted and material to be ground is supplied. Moreover, the internal part of the ball mill is heated to high temperatures due to the heat generated by frictional grinding of the material. Also strong impact and vibration are directly applied to the body of the mill. Thus, it may be said that a ball mill is forced to perform operations under very severe conditions.

As a result, it is certain that a position of the disc controller with respect to the control disc seat can be adjusted in the early stage by loosening the screw with a tool such as a spanner from the outer shell of the mill thereby moving the disc controller forward or backward, but with the lapse of operating time the outer shell itself of the cylinder becomes deformed losing its circularity and, moreover, distortion between the control disc 6 and disc controller 4 occurs, and deformation and twisting of the disc controller itself are unavoidable. Thus, there is a possibility that the support 10 which has exactly supported the disc controller in the early stage of the grinding operation now acts to obstruct the forward or backward movement of the disc controller. In other words, there still remain several constructional disadvantages to be solved in the mentioned prior art in the sense of not being sufficiently resistant and endurable to the mentioned severe conditions peculiar to a huge apparatus such as a ball mill.

SUMMARY OF THE INVENTION

The present invention is provided to solve the above-discussed problem and has an object providing a flow rate regulator for use in ball mill, the performance of which is not affected at all by distortion or deformation of any part of the ball mill.

To accomplish the foregoing object, a flow rate regulator in accordance with the present invention comprises a partition diaphragm which divides a ball mill into not less than two grinding chambers; the partition diaphragm comprising a screen plate facing a primary grinding chamber side, a blind plate facing a secondary grinding chamber side, and a diaphragm chamber formed between the two plates surrounding a center core . In addition, a disc controller is provided to perform an opening and closing operation of a discharge opening of the diaphragm chamber. The disc controller is mounted on an outer shell of the ball mill so as to move forward and backward freely; the disc controller comprising a disc adjustment bar mounted on the outer shell of the mill so as to move forward and backward freely, a disc holder bar connected to the disc adjustment bar through a universal joint so as to be bendable, and a control disc mounted on one end of the disc adjustment bar and having a circular arc surface substantially conforming to a conical surface of the center core.

In the flow rate regulator of the above construction, since the disc controller is not formed of one solid steel bar from the outer shell end of the mill to the control disc end, but is formed of two steel bars connected to each other so as to change their direction freely in the diaphragm chamber through the universal joint irrespective of each other no matter how a positional relation between the outer shell of the mill and the control disc seat in the vicinity of the discharge opening changes, due to deformation or distortion, the disc adjustment bar and the disc holder bar separately change their direction following such deformation or distortion. Thus the disc controller can transmit at all times any change on the outer shell of the mill in a form of forward or backward movement of the control disc.

As a result, in the flow rate regulator in accordance with the invention, even when any variation in the property of the material takes place, the rate of flow from the partition diaphragm to the secondary grinding chamber can be regulated so as to achieve an optimum grinding efficiency or productivity. Furthermore, this regulating function can be performed at all times in the same manner as the initial stage of installing the regulator without influence by deformation, distortion, twisting of the entire regulator or any part thereof which occurs unavoidably with the lapse of operating time.

Referring to a peculiar effect of an embodiment in accordance with the invention in which a primary screen plate having a slit clearance larger than 4 to 6 mm was combined with a wire sieve provided with slits of trapezoidal shape in section and having a slit clearance of 2 mm, it was reported as an experimental result that, as a result of adjusting the disc controller, the level of material located immediately before the partition diaphragm in the primary grinding chamber is not substantially dropped, thus a balanced flow rate between the primary grinding chamber and the secondary grinding chamber is idealy well-balanced resulting in about a 15% saving of power consumption.

Other objects and advantages of the present invention will become apparent in the course of the following description with reference to the accompanying drawings.

BRIEF DESCRIPTION OF THE DRAWINGS

In the drawings forming a part of the present application;

FIGS. 3(A) and 3(B) are respectively a plan view and a side view of a control disc;

FIG. 4 is a longitudinal sectional view showing an example of an advantage achieved by the invention;

FIG. 5 is a longitudinal sectional view showing an example of the prior art.

DESCRIPTION OF THE PREFERRED EMBODIMENTS

Figure 1A:
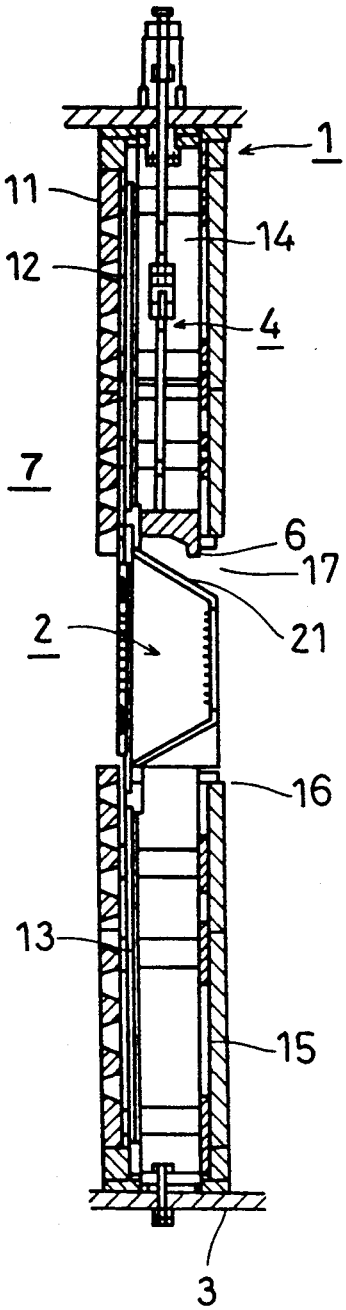
FIGS. 1(A) and 1(B) are respectively a longitudinal sectional view and a rear view showing an embodiment in accordance with the present invention.
Figure 1B:
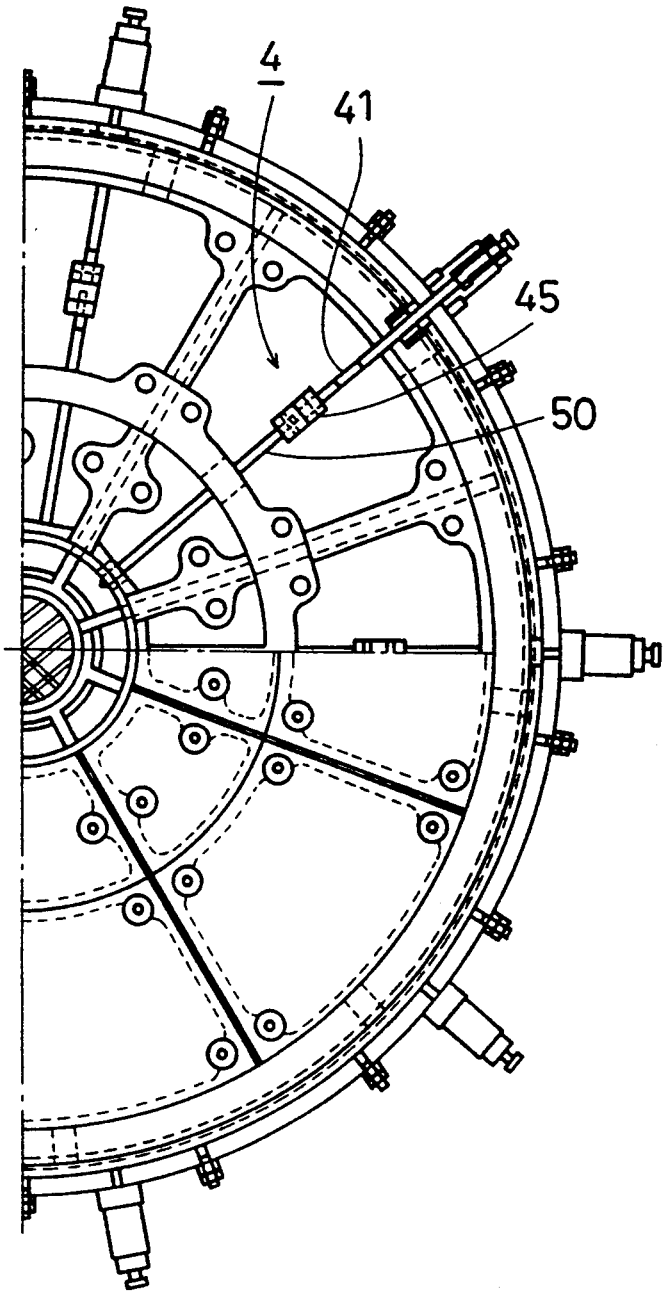
Figure 2A:
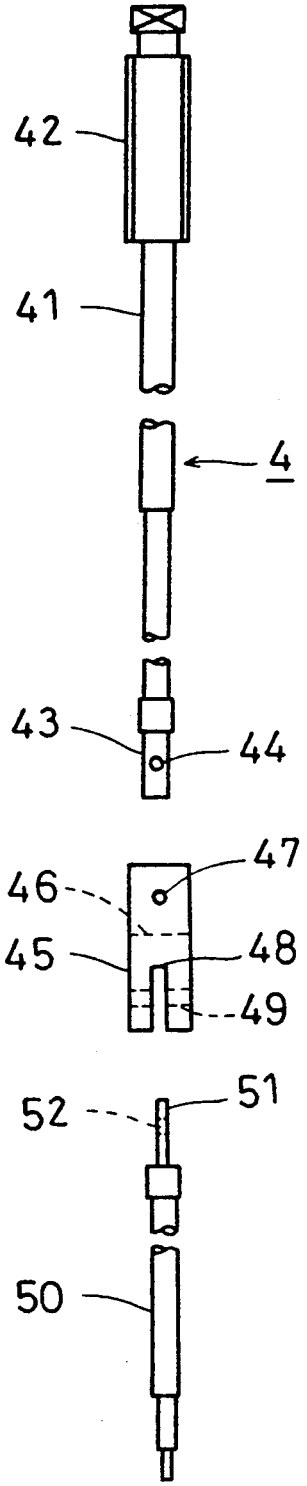
FIGS. 2(A) and 2(B) are respectively an exploded front view and an exploded side view showing a disc controller in accordance with the invention.
Figure 2B:
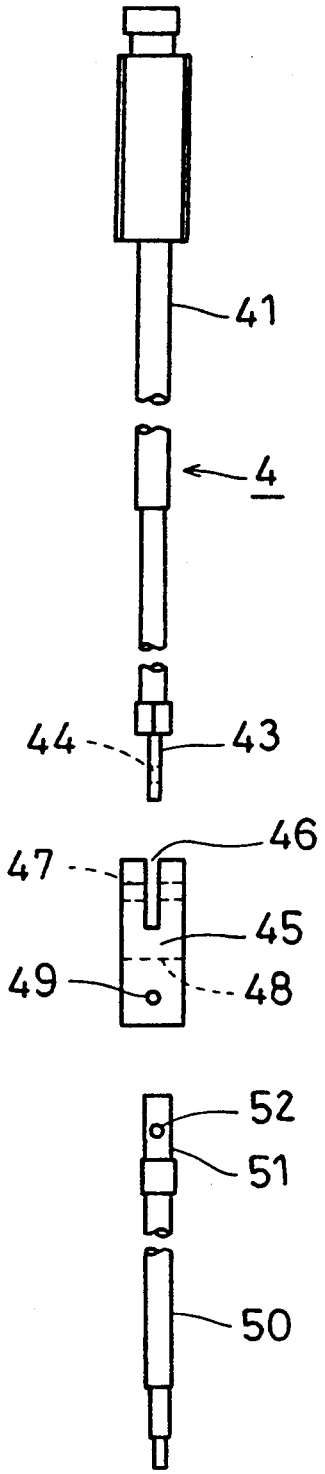
Figure 6A:
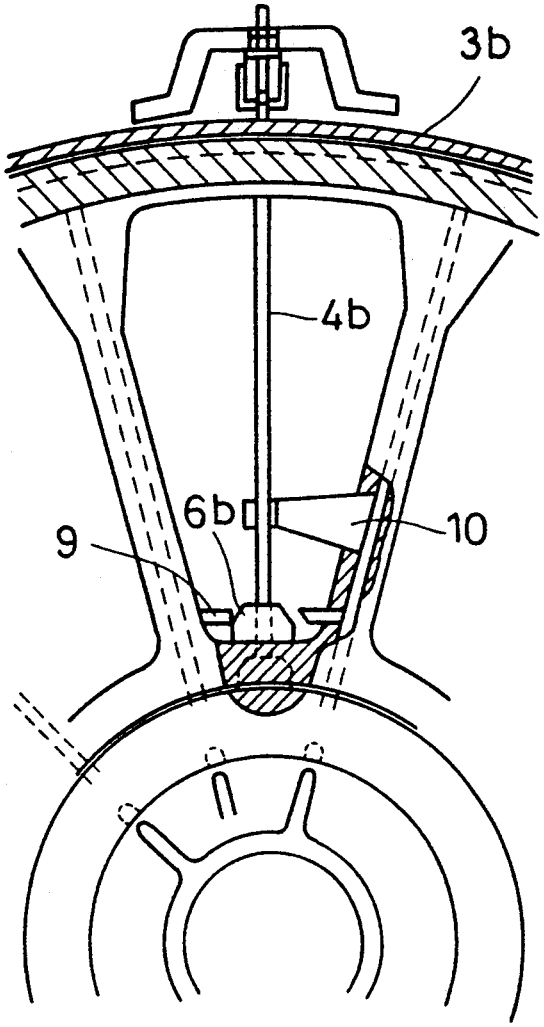
FIG. 6(A) (PRIOR ART)
FIGS. 6(A) and 6(B) are respectively a front view and a longitudinal sectional side view showing the prior art.
Figure 6B:
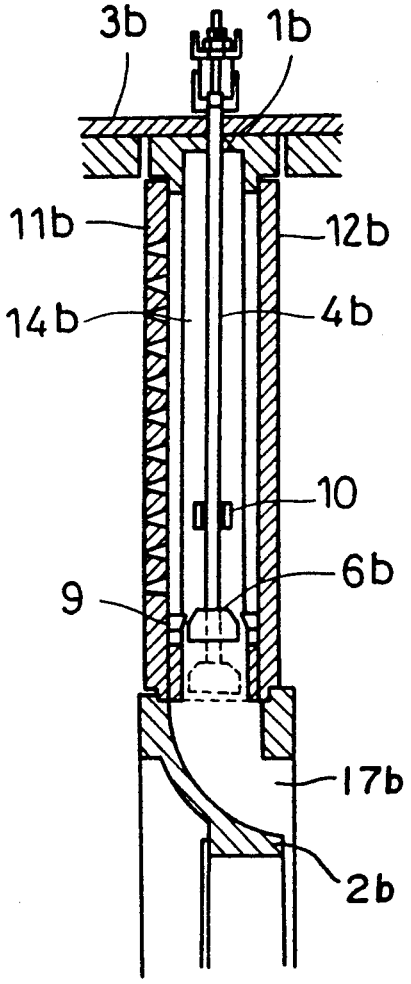
FIG. 6(B) (PRIOR ART)

FIGS. 1(A) and 1(B) are respectively a longitudinal sectional view and a rear view showing an embodiment in accordance with the present invention, and in which, for convenience of explanation, a state of partial stripping off of the uppermost surface (blind plate) of the partition diaphragm 1 is also shown. The primary grinding chamber 7 of a ball mill is shown on the left side of FIG. 1(A), in which a primary screen plate 11, a secondary screen plate 12, a setting frame 13, a diaphragm chamber 14 and a supporting plate 15 are superposed on the front face of the partition diaphragm 1, in order. Finally a blind plate 16 is further applied to close the diaphragm chamber 14. A discharge opening 17 is provided on the center of the fanshaped diaphragm chamber 14 which is radially divided into several divisions, and material is moved into the second grinding chamber 8 (right side in FIG. 1(A)) through a gap formed between the diaphragm chamber 14 and a center core 2. A disc controller 4 is provided through each diaphragm chamber from the outer shell 3 toward the center. FIGS. 2(A) and 2(B) are respectively an exploded front view and an exploded side view showing the disc controller 4 of which exploded components are to be assembled.

In the drawings, a disc adjustment bar 41 is disposed on the upper part, and one end portion of the disc adjustment bar projecting out of the outer shell of the mill comprises a male-threaded rod 42 secured by screwing. This male-threaded rod 42 performs the function of moving the entire disc controller 4 to and from the center of the mill by forward or backward movememt of the male-threaded rod 42 from outside of the mill. The other end of the male-threaded rod 42 is formed into a square-shaped end 43 provided with a pin hole 44 in the center. The upper part of a universal joint 45 comprises a concave groove 46 to be engaged with the mentioned square-shaped end 43 and a pin hole 47 to be engaged with a pin rotatably supporting the square-shaped end 43. In the lower part of the universal joint, there is provided a concave groove 48 which is open at a right angle to the mentioned concave groove 46 and has a pin hole 49 so that a square-shaped end 51 of a disc holder bar 50 is engaged with the concave groove 48 and connected rotatably by a pin to be inserted through a pin hole 52 centered with the mentioned pin hole 49.

It is preferable as another embodiment that, instead of utilizing the forward or backward movement of a screw, the disc adjustment bar 41 is moved forward or backward by means of a hydraulic cylinder. It is also preferable to employ a ball joint comprising a sphere and a spherical adapter instead of the universal joint 45.

A control disc 6 is fixed to the other end (opposite to the square-shaped end) of the disc holder bar 50 as shown in FIGS. 3(A) and 3(B). A control disc seat 61 having a circular arc surface almost the same as the conical surface of the center core is formed on the control disc 6 at this other end of the disc holder bar 50. Accordingly, when the control disc 6 is separate from the conical surface of the center core, a substantially constant gap is formed thereby providing an even discharge opening about the entire circumference. In the foregoing embodiment, a stainless steel wire sieve capable of preventing blinding and establishing a slit clearance to be smaller is employed as the secondary screen plate 12 to perform a smooth flow rate regulation, and it is preferable that the control disc 6 is also made of stainless steel resistant to humidity and chemical change so as to maintain a smooth surface at all times without irregularity, thereby preventing the occurrence of blinding and sticking. When establishing a range of forward and backward movement of the control disc so that a numerical aperture may be freely selected from a range of 1 to 40 $cm^2$/TON (per passing tonnage through the control disc), a flow rate regulation can be performed to keep an optimum balance resulting in an optimum grinding efficiency as a whole with respect to any property of the material when the material is cement clinker.

It is to be understood that the present invention is not limited to the foregoing discription of the preferred embodiments and various changes and modifications may be made in the invention without departing from the spirit and scope thereof.

What is claimed is:

1. A flow rate regulator for a ball mill having an outer shell, comprising a partition diaphragm which divides the ball mill into not less than two grinding chambers;

said partition diaphragm comprising: a center core defining a conical surface; a screen plate facing a primary grinding chamber of the ball mill; a blind plate facing a secondary grinding chamber of the ball mill; a diaphragm chamber formed between said two plates around the center core; and a disc controller for opening and closing a discharge opening of the diaphragm chamber, said partition diaphragm being mounted on outer shell of the ball mill so as to move forward and backward; and said disc controller comprising: a disc adjustment bar mounted on the outer shell of the ball mill so as to move forward and backward; a universal joint; a disc holder bar connected to said disc adjustment bar through the universal joint so as to be bendable; and a control disc mounted on one end of said disc adjustment bar and having a circular arc surface which is substantially coincident with the conical surface of the center core.

2. The flow rate regulator according to claim 1, wherein one end of said disc adjustment bar and one end of said disc holder bar are square-shaped, with the upper part of the universal joint comprising a concave groove in which said square-shapened end of said disc adjustment bar is engagedly inserted and a pin rotatably supports said square-shaped end of said disc adjustment bar, and with the lower part of the universal joint comprising a concave groove into which said square-shaped end of the disc holder bar is engagedly inserted, and a pin rotatably supports said square-shaped end of said disc holder bar; and wherein the square-shaped end of said disc holder bar is provided at a right angle to said concave groove of the upper part of the universal joint.

* * * * *